United States Patent [19]

Kinsinger

[11] Patent Number: 4,500,934

[45] Date of Patent: Feb. 19, 1985

[54] HYBRID SWITCHING DEVICE EMPLOYING LIQUID METAL CONTACT

[75] Inventor: Richard E. Kinsinger, Scotia, N.Y.

[73] Assignee: General Electric Company, Schenectady, N.Y.

[21] Appl. No.: 390,602

[22] Filed: Jun. 21, 1982

[51] Int. Cl.[3] ..... H01H 9/30

[52] U.S. Cl. ..... 361/3; 361/13

[58] Field of Search ..... 361/2, 8, 13, 3, 6; 200/183, 220, 185, 182, 222, 187, 188

[56] References Cited

U.S. PATENT DOCUMENTS 3,711,668 1/1973 Harnden, Jr. ..... 361/13 X 3,783,305 1/1974 Lefferts ..... 361/13

*Primary Examiner*—Harry E. Moose, Jr.

*Attorney, Agent, or Firm*—Lawrence D. Cutter; James C. Davis, Jr.; Marvin Snyder

[57] ABSTRACT

A hybrid electrical current switching device comprises a triggerable solid-state current switch connected in parallel with a mechanical switch in which the current flow depends on the relative positioning of a liquid metal conducting medium. The solid-state switching device operates as a crowbar switch to mitigate effects of arcing.

6 Claims, 9 Drawing Figures

HYBRID SWITCHING DEVICE EMPLOYING LIQUID METAL CONTACT

BACKGROUND OF THE INVENTION

The present invention relates to hybrid switching devices employing solid-state crowbar protection circuitry and, more particularly, to such hybrid electrical switches in which a mechanical current switching element employs one or more liquid metal contacts.

Electromechanical switches employed in the interruption and initiation of electrical current flow paths generally have certain problems associated with them. When such current-carrying switches are removed from their closed to their open positions, inherent inductive effects amost always result in some arcing between the electrical contacts. This arcing can erode and degrade the contacts so that, eventually, the electromechanical switch no longer operates in an acceptable fashion. The principle function of these separate electromechanical contacts is to withstand circuit voltages when the contacts are separated and to assure low contactor impedance when they are closed. The contact resistance of the separable contacts is a critical variable applicable to the closed position. Stability of this contact resistance is often affected by chemical reaction between the contacts and the ambient atmosphere, espcially during arcing. Furthermore, for composite contact materials, segregation of materials near the contact surface with repeated melting and solidification caused by arcing also adversely affects the contact resistance. Moreover, the electromechanical device must be designed so that significant mechanical pressure is applied to the contacts in the closed position to provide the low contact resistance desired. For proper operation, the mechanism must maintain enough contact force to provide microdeformations in the contacts to increase the effective area of the contact. In general, the contact resistance is proportional to the resistivity of the material employed, directly proportional to the square root of the hardness of the material and inversely proportional to the square root of the contact pressure. Accordingly, it is seen that contact material properties such as hardness and resistivity play a significant role in determining contact resistance in electromechanical switches. Furthermore, it is also highly desirable that such materials exhibit low oxidation rates since switches are often exposed to atmospheric conditions. If oxidation of the contact material does occur to any significant degree, it is furthermore necessary that any of the oxidation products not significantly interfere with the functioning of the contacts. These criteria have generally limited the viable contact materials to such substances as silver and gold, alloys thereof, and/or materials employing significant amounts of these expensive materials.

In order to mitigate arcing effects in particular, many switching devices have been proposed in which electromechanical contacts are connected in parallel with a solid-state switching device, such as a thyristor or silicon-controlled rectifier. The solid-state switching element is used to divert or "crowbar" the current away from the contacts either just before or just after contact separation, thereby reducing arcing and easing the requirements of the electromechanical device and its contact materials. Crowbar circuits are described by Horowitz and Hill in their text "The Art of Electronics", Cambridge University Press, 1980, on pages 176–177 thereof. The solid-state switching element is also used to initiate current flow through the switching device just prior to closing the solid contacts, thereby lowering the device voltage and reducing the probability of arcing between the contacts. However, studies conducted by others have indicated that even with the use of additional crowbar circuitry, solid contacts for hybrid circuit switching devices are still likely to involve silver-base materials, at least as an overlay material on another base material such as copper. This conclusion is based primarly on the ability of silver to provide and maintain low contact resistance due to its low electrical resistivity, medium to low hardness, and its relative inertness to surface-contaminating chemical reactions.

A large number of individuals skilled in the art of designing electrical circuit switching devices have proposed the use of solid-state circuitry in parallel with electro-mechanical contacts to reduce arcing on these contacts when opening or closing under load or fault conditions. The following list of patents all appear to disclose such crowbar circuitry in conjunction with electromechanical switching devices. However, all of the patents listed below further appear to involve the use of solid metal contacts employing an essentially standard design. This list includes the following patents: U.S. Pat. No. 2,058,808, issued Nov. 1, 1960 to W. Miller—"Electrical Arc Suppressor"; U.S. Pat. No. 3,237,030, issued Feb. 22, 1966 to R. J. Coburn—"Radio Noise-Free Switch"; U.S. Pat. No. 3,321,668, issued May 23, 1967 to E. S. Baker—"Current Control Apparatus"; U.S. Pat. No. 3,330,992, issued July 11, 1967 to A. R. Perrins—"Electric Switch"; U.S. Pat. No. 3,339,110, issued Aug. 29, 1967 to J. P. Jones—"Relay Circuits"; U.S. Pat. No. 3,389,301, issued June 18, 1968 to E. I. Siwko—"Arc Suppressing Circuit"; U.S. Pat. No. 3,395,316, issued June 30, 1968 to P. A. Denes et al.—"Electrical Switch With Contact Protector"; U.S. Pat. No. 3,402,302, issed Sept. 17, 1968 to E. J. Coburn—"Radio Noise-Free Switch"; U.S. Pat. No. 3,466,503, issued Sept. 9, 1969 to L. F. Goldberg—"Assisted Arc AC Circuit Interruption"; U.S. Pat. No. 3,474,293, issued Oct. 21, 1969 to E. I. Siwko et al.—"Arc Suppressing Circuits"; U.S. Pat. No. 3,504,233, issued Mar. 31, 1970 to E. L. Hurtle—"Electric Circuit Interrupting Device With Solid State Shorting Means"; U.S. Pat. No. 3,539,775, issued Nov. 10, 1970 to C. F. Casson—"Double-Make Contact Switching Apparatus With Improved AC Arc Suppression Means"; U.S. Pat. No. 3,555,353, issued Jan. 12, 1971 to C. F. Casson—"Means Effecting Relay Contact Arc Suppression in Relay Controlled Alternating Load Circuits"; U.S. Pat. No. 3,558,910, issued Jan. 26, 1971 to R. G. Dale et al.—"Relay Circuits Employing a Triac to Prevent Arcing"; U.S. Pat. No. 3,588,605, issued June 28, 1971 to C. F. Casson—"Alternating Current Switching Apparatus With Improved Electrical Contact Protection"; U.S. Pat. No. 3,614,464, issued Oct. 19, 1971 to W. V. Chumakov—"Arcless Tap- or Source-Switching Apparatus Using Series-Connected Semiconductors"; —U.S. Pat. No. 3,633,069, issued Jan. 4, 1972 to G. Bernard—"Alternating Current Circuit-Interrupting System Comprising a Rectifier Shunting Path"; —U.S. Pat. No. 3,639,808, issed Feb. 1, 1972 to G. R. Ritzow, "Relay Contact Protecting Circuit"; U.S. Pat. No. 3,783,305, issued Jan 1, 1974 to P. Lefferts—"Arc Elimination Circuit"; U.S. Pat. No. 3,982,137, issued Sept. 21, 1976 to J. K. Penrod—"Arc Suppressor Circuit"; U.S. Pat. No. 4,025,820, issued May 24, 1977 to J. K. Penrod—"-Contactor Device Including Arc Suppression Means"; U.S. Pat. No. 4,074,333, issued Feb. 14, 1978 to K. Kurakami et al.—"AC Relay System"; U.S. Pat. No. 4,152,634, issued May 1, 1979 to J. K. Penrod—"Power Contactor and Control Circuit"; U.S. Pat. No. 4,068,273, issued Jan. 10, 1978 to A. Metzler—"Hybrid Power Switch".

However, it is apparent that hybrid switching devices must, of necessity, incur an added cost associated with the circuitry for performing the crowbar function. Accordingly, for greater cost competitiveness with conventional electromechanical switches, it is highly desirable that the cost of the solid-state crowbar circuitry be compensated by changes in the design of the electromechanical portion of the hybrid switching device. In particular, two of the large cost elements associated with most low voltage (less than 1,500 volts) switches are the contact material and the driving mechanism. The contact material is expensive because it preferably employs a noble metal such as silver or gold. The drive mechanism also tends to be expensive in that it requires mechanical devices for holding the switch contacts in a forcibly closed position with sufficient pressure to cause microdeformations and yet, in the next instant of time, to quickly separate the contacts.

In sum, it is seen that electromechanical switching devices generally require the use of relatively expensive contact material. Furthermore, it is seen that even in situations employing crowbar circuitry to mitigate arcing effects, expensive contact material is also generally required. Furthermore, it is seen that the cost of the crowbar circuitry has in the past added significantly to the cost of hybrid switching circuit devices without concomitant savings associated with the electromechanical portion of the switch. It is further seen that while liquid metal contact switching devices have been employed in the past, they have generally not been employed in circuits in which high arcing currents are a consideration. This is generally the result of vapor pressure problems associated with liquid metal contact devices. In liquid metal switches which are opened to the atmosphere, arcing can rapidly contribute to vaporization of the liquid metal. In the case that the liquid metal is mercury, it is generally appreciated that the escape of mercury vapor to the surrounding atmospheric environment would generally be detrimental. In the situation in which the liquid metal is contained within a sealed environment, normal arcing in the switch results in the build up of significant vapor pressures from the volatilized liquid metal. Containment of these high vapor pressures is a significant design challenge, solved only at added cost to the device. Accordingly, for these reasons it is seen, particularly from the list of patents cited above, that the use of liquid metals in switches carrying high levels of arcing current has not been employed.

SUMMARY OF THE INVENTION

In accordance with a preferred embodiment of the present invention, a hybrid electrical current switching device comprises a triggerable solid-state current switching device connected in parallel with a mechanical current switching device in which current flow depends on the relative positioning of a liquid metal conducting medium. In a preferred embodiment of the present invention, the liquid metal conducting medium is disposed within a sealed housing. The present invention also preferably includes triggering means which operate to trigger the solid-state device into a low resistance state at approximately the same time that the mechanical switch is moved to an open position. Furthermore, the triggering means also preferably operates to switch the solid-state device into a low resistance state immediately prior to closing of the mechanical switch.

In the hybrid switch described above, there is no means required for holding the mechanical switch contacts together under pressure. Furthermore, there is no need to provide expensive contacts. Additionally, the presence of the solid-state current diverting circuitry, that is the crowbar circuitry, acts to mitigate the effects of arcing and the concomitant problem of pressure buildup within a sealed mechanical switch housing. Furthermore, several different forms of liquid metal switching elements may be employed, depending upon the load current and speed requirements of the switch.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
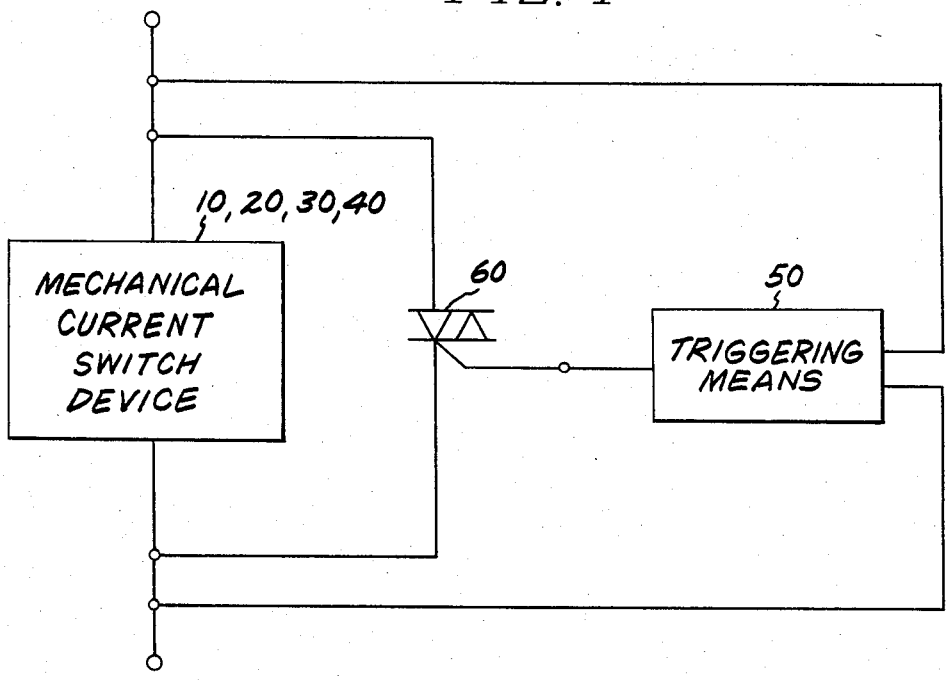
FIG. 1 is a schematic circuit diagram illustrating one embodiment of the present invention.

FIG. 1 illustrates a preferred embodiment of the present invention employing mechanical current switching device 10, 20, 30 or 40 in which current flow depends on the relative positioning of a liquid metal conducting medium. The switch device may comprise any of the embodiments 10, 20, 30 or 40 illustrated in FIGS. 2, 3, 4 and 5 and which are more particularly described below. Switching device 10, 20, 30 or 40 is electrically connected in a parallel configuration with a triggerable solid-state current switching device 60, such as back-to-back thyristors or silicon-controlled rectifiers. It is this solid-state device which provides crowbar protection in the present invention. The trigger electrode for the solid-state switch 60 is driven by triggering means 50.

Triggering means 50 preferably operates in the following manner. When the mechanical liquid metal switch is at rest in either the closed and conducting or open and nonconducting condition, the semiconductor device is in a high impedance (ungated) state. After mechanical switch 10, 20, 30, 40 has been opened for a relatively long period of time, a gating signal is sent to solid-state switch 60 upon initiation of mechanical closing of the liquid switch. Furthermore, this gating signal is maintained for a period of time sufficient to ensure good electrical continuity through the liquid metal within the switch housing. Lastly, when mechanical switch 10, 20, 30, 40 is being changed from a closed to an open state, a gating signal is sent to solid-state switch 60 at or about the instant of arc development so as to switch the semiconductor device into a low impedance state. In accordance with one embodiment of the present invention, a gating signal may be sent to semiconductor device 60 upon the development of a voltage of greater than about 5 volts across the liquid metal switch. This is the approximate voltage developed during the early stages of arcing. In accordance with another embodiment of the present invention, initiation of a gating signal to trigger a low impedance condition may be made to depend upon a joint condition, such as signals indicating that the liquid metal switch is in the open condition and there is a detectable current flowing through the liquid metal switch. Still another method would initiate the gating signal after a fixed and predetermined delay from the signal to activate the mechanical switch 10, 20, 30, 40. The selection of the most appropriate logic for initiation of the gating signal depends, in part, on the specific electromechanical characteristics of switch 10, 20, 30, 40. Furthermore, the embodiment illustrated in FIG. 1 illustrates the use of a bipolar semiconductor device 60. However, monopolar solid-state switches may be employed. Triggering means 50 are conventionally employed in the electrical interruption arts, particularly in those situations employing crowbar-type protection circuitry. Such triggering means can be found in several of the circuits described in the patents listed above.

Figure 5:
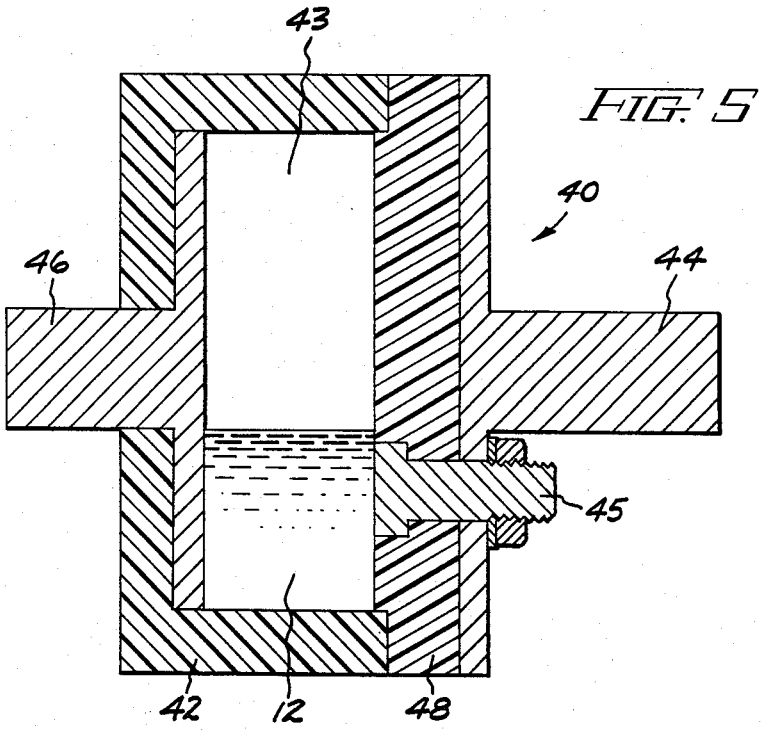
FIG. 5 is a cross-sectional side elevation view illustrating yet another liquid metal switch in which switching action is achieved by rotation.

An important aspect of the present invention is the construction of a hybrid switching device in which a triggerable solid-state switch is disposed in parallel across an electromechanical switch in which the electrical connection is made through a liquid metal conductor, such as mercury. While mercury is the preferable liquid metal employed in the present invention, other related materials such as alkali metals having similar properties may be substituted for mercury. In such liquid metal switches, electrical connection is made through a liquid metal conductor in one of several methods. For example, in FIG. 2, connection is made by inserting a solid contact into a liquid pool. In FIG. 3, contact is made by flowing liquid metal up to a solid metal contact. In FIG. 4, circuit formation is accomplished by completing electrical continuity through an aperture connecting two liquid metal pools. In FIG. 5, circuit formation is accomplished by rotating the housing to lower a terminal contact into a liquid metal pool.

Figure 2A:
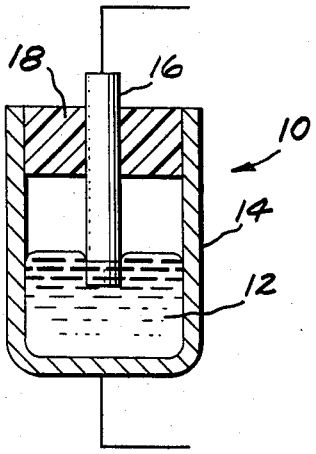
FIG. 2A is a cross-sectional side elevation view illustrating a liquid metal switching element employing a sliding metal contact.
Figure 2B:
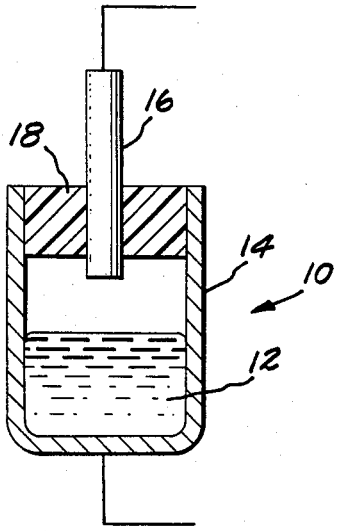
FIG. 2B is similar to FIG. 2A with the switch shown in its off or open position.

In FIG. 2, liquid metal switch 10 comprises conductive housing 14 forming one of the two switch contacts. Liquid metal 12 is disposed within housing 14 and contact is made by slidably moving a second solid metal electrode contact 16 through insulating plug 18. FIG. 2A shows switch 10 in a closed position and FIG. 2B illustrates the same switch in an open position. The motion of the solid contact may be affected either through a sliding motion or through a bellows action. The action of switch 10 is rapid and under direct control. Furthermore, housing 14 is preferably sealed by plug 18 to prevent the escape of volatized liquid metal vapor to the atmosphere, particularly under conditions of relatively high internal pressures.

Figure 3A:
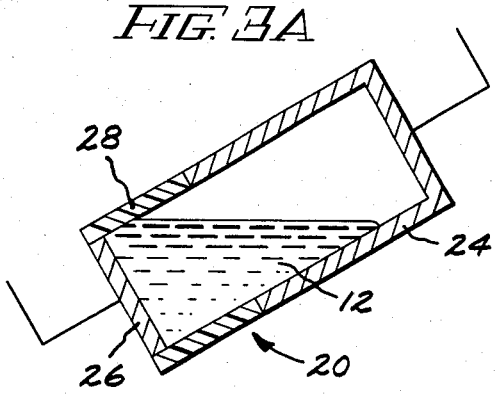
FIG. 3A is a cross-sectional side elevation view illustrating a liquid metal switching device in which switching action is achieved by rotation of the housing.
Figure 3B:
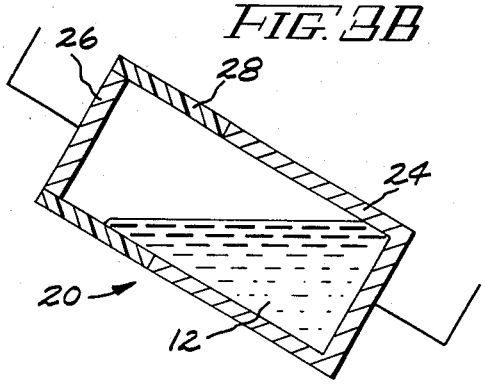
FIG. 3B is similar to FIG. 3A except that the switch is shown in the off or open position.

A second form of liquid metal switch is illustrated in FIGS. 3A and 3B. Here, switch 20 comprises a housing having electrically conductive portion 24 and electrically insulating portion 28 electrically separating conductive end plate 26 from conductive housing portion 24. Liquid metal 12 is disposed within the housing. End plate 26 and housing portion 24 form two stationary solid electrodes which, in the closed position, are bridged by a liquid metal column in one position. However, reorientation of the container to a position such as that shown in FIG. 3B causes liquid metal 12 to flow away from end plate 26 and thus breaks the electrical circuit. Because there are no mechanical feedthroughs in this embodiment, such a container is easily sealed, thus restricting the environment to which the contact surfaces are exposed and preventing the release of internally generated, vaporous material. Normal arcing occurring in such a switch can result in significant pressure buildup under high arc current conditions. However, crowbar protection circuitry diverts the arcing current rapidly enough so that pressure containment is not a significant problem. Since switch 20 is opened and closed by a simple rotation of the housing, mechanism requirements are minimal. However, since the liquid flow contact separation is effected by gravity, it is limited in speed and may have greater than usual shot-to-shot timing variations.

Figure 4A:
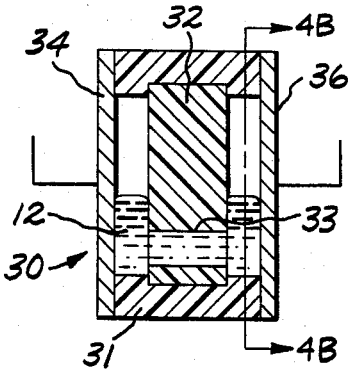
FIG. 4A is a cross-sectional side elevation view illustrating a liquid metal switch in which a movable liquid metal channel is provided for switch actuation.
Figure 4B:
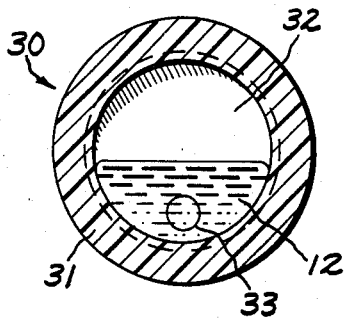
FIG. 4B is a front cross-sectional side elevation view of the switch shown in FIG. 4A.
Figure 4C:
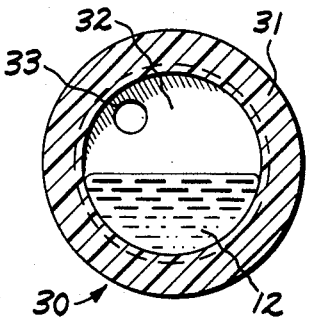
FIG. 4C is similar to FIG. 4B except that the switch is shown in its off or open position.

FIG. 4 illustrates the construction and operation of liquid metal switch 30 comprising solid end electrodes 34 and 36 which, together with annular insulating portion 31, define a housing holding liquid metal 12 as a conducting contact medium. Within the thus-defined housing, there is disposed rotatable insulating disk 32 having an eccentrically-positioned flow channel 33 defined therein. In the closed position illustrated in FIGS. 4A and 4B, disk 32 is positioned with channel 33 in a lower position so that channel 33 completes an electrical circuit between two liquid metal pools which are in contact with end electrodes 34 and 36, thus completing the circuit. As disk 32 is rotated so that channel 33 is above the level of at least one of the liquid metal pools, electrical contact is broken. This latter, switch-open situation is illustrated in FIG. 4C. Accordingly, switch 30 exhibits many of the features exhibited by switch 20. However, because of the presence of disk 32 which operates as an additional insulating barrier between the liquid metal pools, switch 30 exhibits greater hold-off voltages than switch 20, under similar dimensional constraints.

FIG. 5 illustrates the construction of liquid metal switch 40 including an insulating housing comprising portions 42 and 48. Housing portions 42 and 48 are rotatable together in a manner similar to switch 20 in FIG. 4A. The housing contains a liquid metal pool 12 such as mercury, together with an atmosphere 43, preferably comprising air, argon, or mixtures thereof. Such an atmosphere may be employed not only in the switch shown in FIG. 5, but also in the other liquid metal switches shown in FIGS. 2-3. Terminal contact 45 is disposed through housing portion 48. A second terminal contact 46 is disposed through housing portion 42, in the manner shown. When switch 40 is in the closed position, as is illustrated in FIG. 5, current flows through conductive contacts 46, liquid metal pool 12 and terminal contact 45. Additionally, in the embodiment shown, contact 45 is electrically connected to terminal plate 44 by any conventional means, such as by the nut and washer illustrated. Thus, the mechanical stress of rapid rotation of the housing is born by metallic members 44 and 46. In a fashion similar to the switch shown in FIG. 4, terminal contact 45 is mounted eccentrically with respect to the center of rotation of the housing. Accordingly, as the housing is rotated, contact 45 is removed from liquid metal pool 12, thus breaking the electrical connection.

From the above it may be appreciated that the present invention provides a heretofore unemployed form of hybrid switch. In particular, it is seen that the hybrid switch of the present invention is economical in that conventionally required electromechanical switching mechanisms are not required and because the present invention does not require the use of expensive electrode contact materials employing precious metals. It is further seen that the hybrid switch of the present invention significantly mitigates the effect of arcing and its concomitant effects upon pressure buildup in liquid metal switch housings.

While the invention has been described in detail herein in accord with certain preferred embodiments thereof, many changes and modifications therein may be effected by those skilled in the art. Accordingly, it is intended by the appended claims to cover all such modifications and changes as fall within the true spirit and scope of the invention.

The invention claimed is:

1. A hybrid electrical current switching device comprising:

a mechanical current switch device having open and cloed positions and in which current flow is dependent on the relative positioning of a liquid metal conducting medium; and a triggerable solid-state current switch device connected in parallel with said mechanical current switch device, so that arc formation across the contacts of said mechanical current switch device is controllable by triggering of said solid-state current switch device, which is operable to divert current from said switch in response to arc formation conditions.

2. The device of claim 1 in which said liquid metal is disposed within a sealed housing.

3. The device of claim 1 further including triggering means operating to switch said solid-state device into a low resistance state at about the same time that said mechanical switch is moved to its open position.

4. The device of claim 3 in which said triggering means further operates to switch said solid-state device into a low resistance state at about the same time that said mechanical switch is moved to its closed position.

5. The device of claim 1 in which said liquid metal comprises mercury.

6. The device of claim 1 in which said liquid metal comprises an alkali metal or combination of alkali metals.

* * * * *